US006694538B1

(12) United States Patent
Jones

(10) Patent No.: US 6,694,538 B1
(45) Date of Patent: Feb. 24, 2004

(54) PORTABLE TOILET ENCLOSURE ASSEMBLY

(76) Inventor: Beatrice Jones, 3419 Arlington Ave., St. Louis, MO (US) 63120

( * ) Notice: Subject to any disclaimer, the term of this patent is extended or adjusted under 35 U.S.C. 154(b) by 0 days.

(21) Appl. No.: 10/340,777

(22) Filed: Jan. 13, 2003

(51) Int. Cl.[7] ..... A47K 11/04

(52) U.S. Cl. ..... 4/476; 4/599; 4/607; 4/608; 4/610

(58) Field of Search ..... 4/476, 477, 460, 4/599, 607, 608, 610, 144.1

(56) References Cited

U.S. PATENT DOCUMENTS

| | | | | |
|---|---|---|---|---|
| 1,450,218 A | | 4/1923 | Nenoff | |
| 1,538,311 A | | 5/1925 | Anticknap | |
| 1,567,484 A | | 12/1925 | Beard | |
| 1,828,147 A | | 10/1931 | Kamman | |
| 3,992,727 A | * | 11/1976 | Elkins | 4/144.1 |
| 4,883,016 A | * | 11/1989 | Larson | 4/599 |
| 4,918,765 A | | 4/1990 | Harding | |
| 5,216,763 A | | 6/1993 | Grenier | |
| 5,937,452 A | | 8/1999 | Brewer | |
| D424,667 S | | 5/2000 | Ariza et al. | |
| 6,374,432 B1 | * | 4/2002 | Morris | 4/476 |

* cited by examiner

*Primary Examiner*—Tuan N. Nguyen

(57) ABSTRACT

A portable toilet enclosure assembly for providing privacy for users of portable toilets which may be positioned in the open. The portable toilet enclosure assembly includes a base assembly including a support base, and also including wheels upon which the support base is mounted; and also includes a height adjustable pole assembly being mounted upon the support base; and further includes a curtain support assembly including a bracket being attached to the height adjustable pole assembly, and also including tubular curtain rod support member being pivotally attached to the bracket, and further including a curtain rod being adjustably attached to the tubular curtain rod support member, and also including curtain hangers being movably mounted upon the curtain rod; and also includes a curtain being attached to and depending from the curtain hangers.

4 Claims, 3 Drawing Sheets

PORTABLE TOILET ENCLOSURE ASSEMBLY

BACKGROUND OF THE INVENTION

1. Field of the Invention

The present invention relates to portable toilet enclosures and more particularly pertains to a new portable toilet enclosure assembly for providing privacy for users of portable toilets which may be positioned in the open.

2. Description of the Prior Art

The use of portable toilet enclosures is known in the prior art. More specifically, portable toilet enclosures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,538,311; U.S. Pat. No. 5,216,763; U.S. Pat. No. 1,567,484; U.S. Pat. No. 1,828,147; U.S. Pat. No. 5,937,452; U.S. Pat. No. 4,918,765; U.S. Pat. No. 1,450,218; and U.S. Pat. No. Des. 424,667.

While these devices fulfill their respective, particular objectives and requirements, the aforementioned patents do not disclose a new portable toilet enclosure assembly. The prior art includes tents and stakes being set up to enclose about portable toilets.

SUMMARY OF THE INVENTION

The general purpose of the present. invention, which will be described subsequently in greater detail, is to provide a new portable toilet enclosure assembly which has many of the advantages of the portable toilet enclosures mentioned heretofore and many novel features that result in a new portable toilet enclosure assembly which is not anticipated, rendered obvious, suggested, or even implied by any of the prior art portable toilet enclosures, either alone or in any combination thereof. The present invention includes a base assembly including a support base, and also including wheels upon which the support base is mounted; and also includes a height adjustable pole assembly being mounted upon the support base; and further includes a curtain support assembly including a bracket being attached to the height adjustable pole assembly, and also including tubular curtain rod support member being pivotally attached to the bracket, and further including a curtain rod being adjustably attached to the tubular curtain rod support member, and also including curtain hangers being movably mounted upon the curtain rod; and also includes a curtain being attached to and depending from the curtain hangers. None of the prior art includes the combination of the elements of the present invention.

There has thus been outlined, rather broadly, the more important features of the portable toilet enclosure assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable toilet enclosure assembly which has many of the advantages of the portable toilet enclosures mentioned heretofore and many novel features that result in a new portable toilet enclosure assembly which is not anticipated, rendered obvious, suggested, or even implied by any of the prior art portable toilet enclosures, either alone or in any combination thereof.

Still another object of the present invention is to provide a new portable toilet enclosure assembly for providing privacy for users of portable toilets which may be positioned in the open.

Still yet another object of the present invention is to provide a new portable toilet enclosure assembly that is easy and convenient to set up, use, and take down.

Even still another object of the present invention is to provide a new portable toilet enclosure assembly that can be carried anywhere and can be easily stowed within a vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
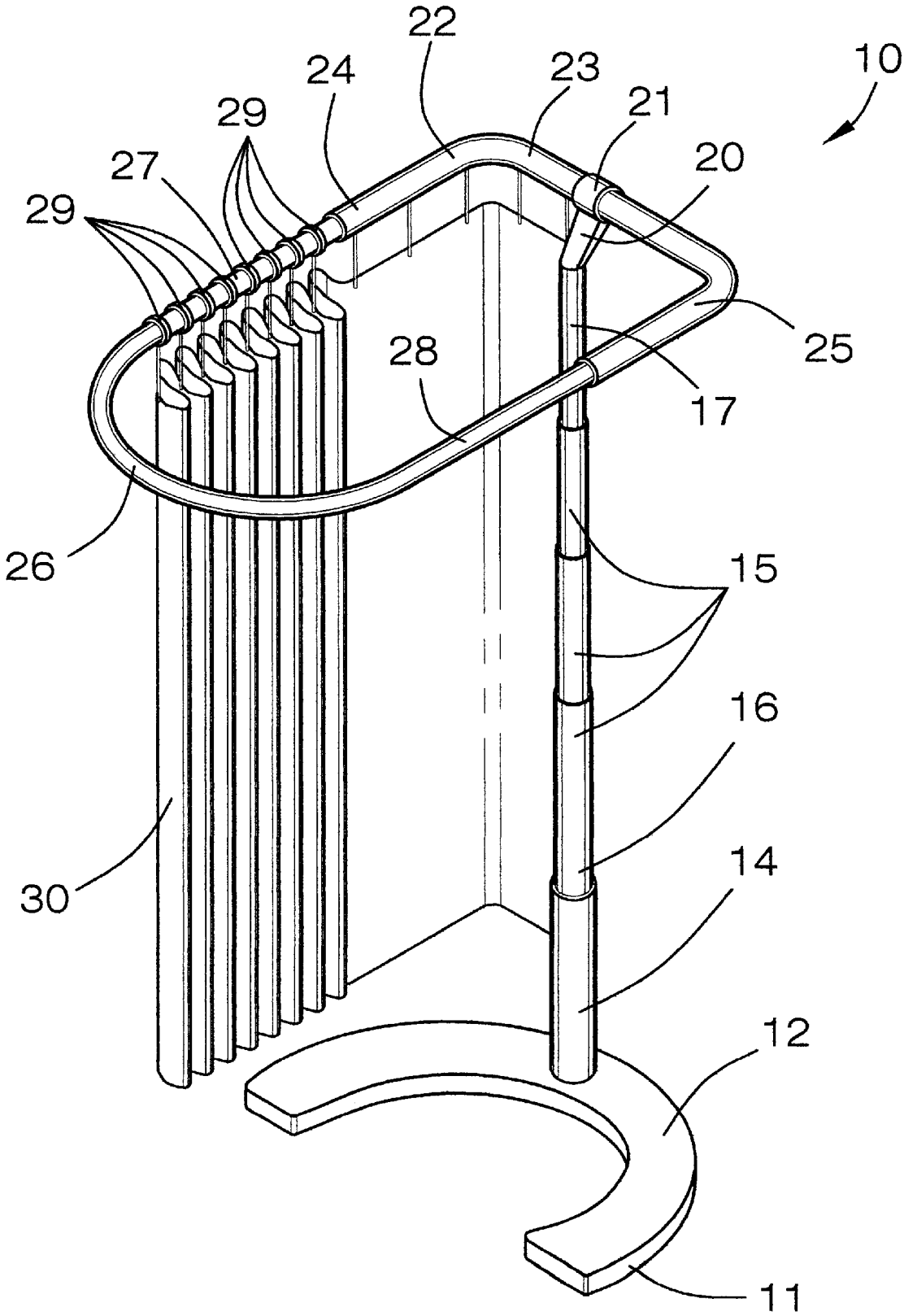
FIG. 1 is a perspective view of a new portable toilet enclosure assembly according to the present invention and being shown in use.
Figure 2:
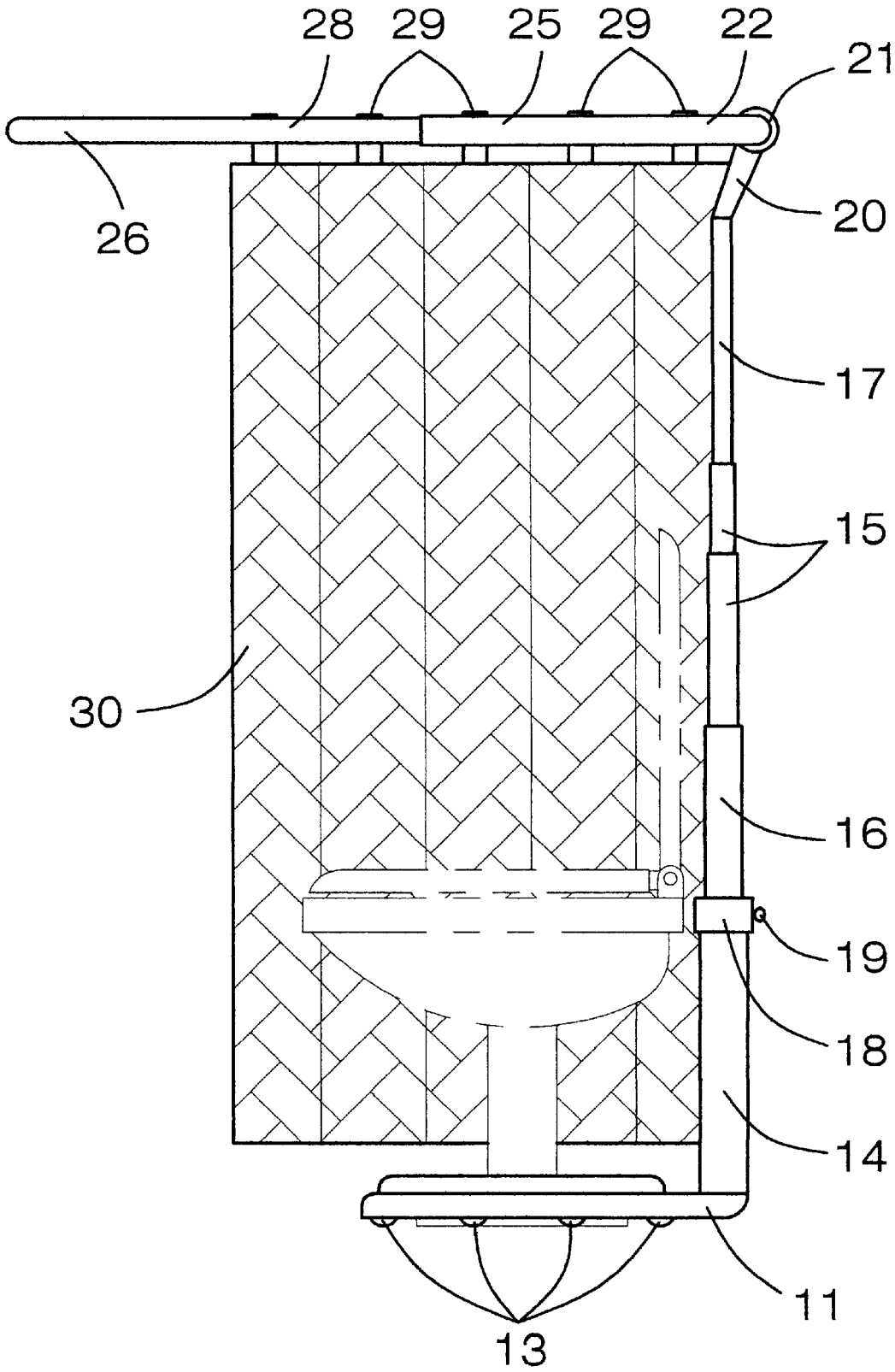
FIG. 2 is a side elevational view of the present invention.
Figure 4:
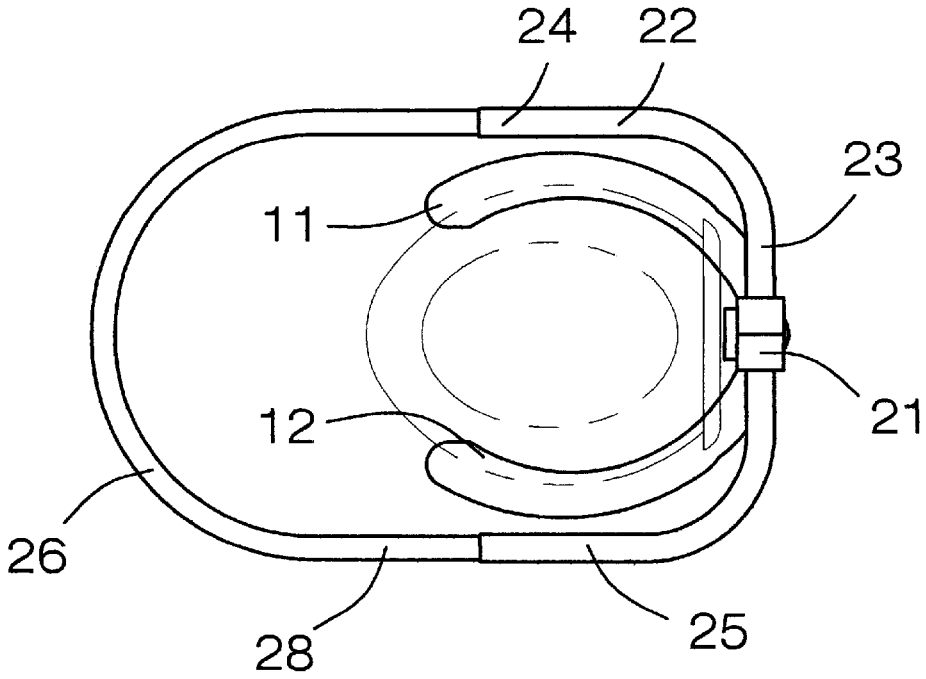
FIG. 4 is a top plan view of the present invention.
Figure 3:
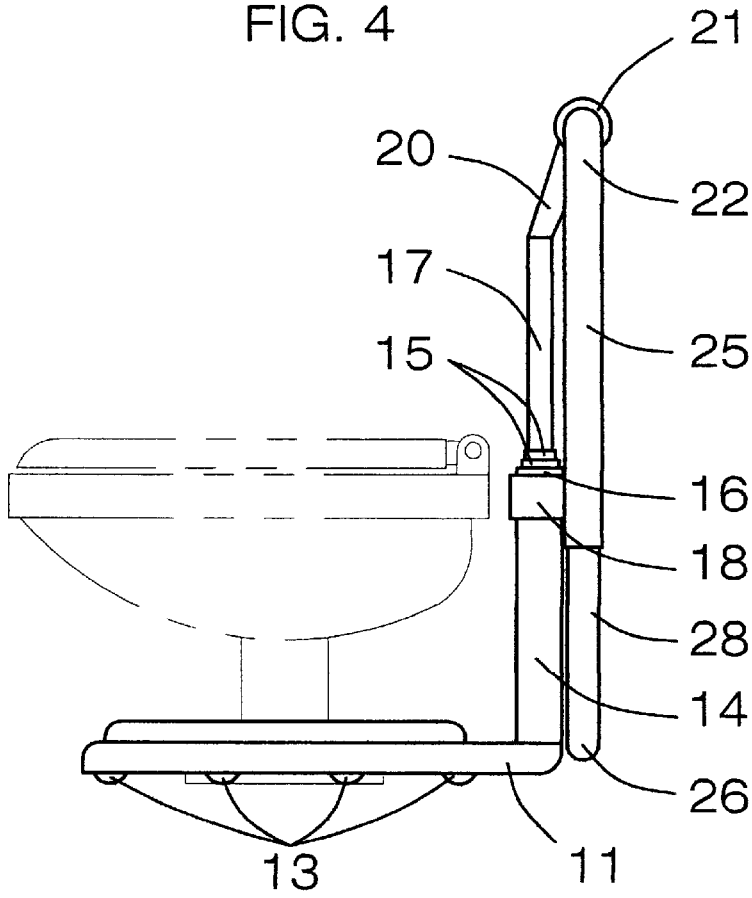
FIG. 3 is a side elevational view of the present invention being shown in a nonuse position.

With reference now to the drawings, and in particular to FIGS. 1 through 4 thereof, a new portable toilet enclosure assembly embodying the principles and concepts of the present invention and generally designated by the reference numeral 10 will be described.

As best illustrated in FIGS. 1 through 4, the portable toilet enclosure assembly 10 generally comprises a base assembly including a support base 11, and also including wheels 13 upon which the support base 11 is conventionally mounted. The support base is a semi-circular-shaped plate having a bottom side and a topside 12 with the wheels 13 being spacedly disposed upon the bottom side of the semi-circular-shaped plate.

A height adjustable pole assembly is conventionally mounted upon the support base 11. The height adjustable pole assembly includes a tubular base section 14 being vertically-erected and conventionally disposed upon the topside 12 of the support base 11, and also includes a plurality of elongate tubular sections 15 being telescopingly and conventionally extended from the tubular base section 14, and further includes a collar 18 being conventionally disposed about a top end of the tubular base section 14 and being disposed about the bottom-most elongate tubular section 16, and also includes a fastener 19 being adjustably and conventionally disposed through the collar 18 and being engageable to the bottom-most elongate tubular section 16 to secure said elongate tubular sections 15 at extended positions from said tubular base section 14.

A curtain support assembly includes a bracket 20,21 being conventionally attached to the height adjustable pole assembly, and also includes tubular curtain rod support member 22 being pivotally attached to the bracket 20,21, and further includes a curtain rod 26 being adjustably attached to the tubular curtain rod support member 22, and also includes curtain hangers 29 being movably mounted about the curtain rod 26. The bracket 20,21 includes a sleeve support member 20 being conventionally attached to the uppermost elongate tubular section 17, and also includes a sleeve 21 being conventionally attached to the sleeve support member 20 and having a longitudinal axis which is disposed generally perpendicular to longitudinal axes of the elongate tubular sections 15. The tubular curtain rod support member 22 is U-shaped, and has a main portion 23 which is rotatably disposed in and through the sleeve 21, and also has end portions 24,25 being disposed parallel to one another and being angled generally perpendicular relative to the main portion 23 and having open ends. The curtain rod 26 is arcuate shaped and has end portions 27,28 which are retractably extended in the open ends of the tubular curtain rod support member 22. The curtain rod 26 in combination with the tubular curtain rod support member 22 form a closed loop. The tubular curtain rod support member 22 is pivotable about the longitudinal axis of the sleeve 21 from a horizontal in-use position above a toilet to a vertical non-use position behind the toilet. The curtain hangers 29 have ring portions which are movably and removably disposed about the curtain rod 26. A curtain 30 is conventionally attached to and depends from the curtain hangers 29 for enclosing about the toilet.

In use, the user places the support base 11 about the sides and back of the toilet and extends the elongate tubular sections 15 from the tubular base section 14 and secures the elongate tubular sections 15 and upright extended positions. The user then rotates the tubular curtain rod support member 22 about the longitudinal axis of its main portion 23 so that it is horizontally position above the toilet. Next, the user hangs the curtain 30 from the curtain rod 26 and slides the curtain 30 along the curtain rod 26 to enclose about the toilet so that the user can use the toilet in private.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those, illustrated in the drawings and described in the specification are intended to be encompassed by the present invention.

Therefore, the foregoing is considered as illustrative only of the principles of the portable toilet enclosure assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable toilet enclosure assembly comprising:

a base assembly including a support base, and also including wheels upon which said support base is mounted;

a height adjustable pole assembly being mounted upon said support base;

a curtain support assembly including a bracket being attached to said height adjustable pole assembly, and also including a tubular curtain rod support member being pivotally attached to said bracket, and further including a curtain rod being adjustably attached to said tubular curtain rod support member, and also including curtain hangers being movably and removably mounted upon said curtain rod;

a curtain being attached to and depending from said curtain hangers, wherein said support base is a semi-circular-shaped plate having a bottom side and a topside and being adapted to enclose about sides and back of a toilet, said wheels being spacedly disposed upon said bottom side of said semi-circular-shaped plate;

wherein said height adjustable pole assembly includes a tubular base section being vertically-erected upon said topside of said support base, and also includes a plurality of elongate tubular sections being telescopically extended from said tubular base section, and further includes a collar being disposed about a top end of said tubular base section and being disposed about a bottom most said elongate tubular section, and also includes a fastener being adjustably disposed through said collar and being engageable to a bottom-most said elongate tubular section for securing said elongate tubular sections in extended positions; and wherein said bracket includes a sleeve support member being attached to an uppermost said elongate tubular section, and also includes a sleeve being attached to said sleeve support member and having a longitudinal axis which is disposed generally perpendicular to longitudinal axes of said elongate tubular sections.

2. A portable toilet enclosure assembly as described in claim 1, wherein said tubular curtain rod support member is U-shaped, and has a main portion which is rotatably disposed in and through said sleeve, and also has end portions being disposed parallel to one another and being angled generally perpendicular relative to said main portion and having open ends.

3. A portable toilet enclosure assembly as described in claim 2, wherein said curtain rod is arcuate shaped and has end portions which are retractably extended in said open ends of said tubular curtain rod support member, said curtain rod in combination with said tubular curtain rod support member forming a closed loop, said tubular curtain rod support member being pivotable about the longitudinal axis of said sleeve from a horizontal in-use position above a toilet to a vertical non-use position behind the toilet.

4. A portable toilet enclosure assembly as described in claim 3, wherein said curtain hangers have ring portions which are movably and removably disposed about said curtain rod.

* * * * *